United States Patent [19]

Nelson

[11] 4,225,417

[45] Sep. 30, 1980

[54] CATALYTIC REFORMING PROCESS WITH SULFUR REMOVAL

[75] Inventor: Thomas J. Nelson, Mt. Prospect, Ill.

[73] Assignee: Atlantic Richfield Company, Philadelphia, Pa.

[21] Appl. No.: 9,001

[22] Filed: Feb. 5, 1979

[51] Int. Cl.[2] ..... C10G 25/00; C10G 23/02

[52] U.S. Cl. ..... 208/89; 208/91

[58] Field of Search ..... 208/89, 91, 88, 249, 208/139

[56] References Cited

U.S. PATENT DOCUMENTS

| | | | |
|---|---|---|---|
| 1,840,158 | 1/1932 | Cross | 208/249 |
| 2,177,343 | 10/1939 | Hughes | 208/249 |
| 2,314,576 | 3/1943 | Doran | 208/249 |
| 2,618,586 | 11/1952 | Hendel | 208/249 |
| 2,922,756 | 1/1960 | Watkins | 208/91 |
| 2,950,229 | 8/1960 | Batchelor et al. | 208/249 |
| 3,320,157 | 5/1967 | Arey, Jr. et al. | 208/249 |
| 3,996,130 | 12/1976 | Nametkin et al. | 208/249 |
| 4,137,153 | 1/1979 | Antos | 208/139 |
| 4,155,835 | 5/1979 | Antal | 208/89 |

*Primary Examiner*—George Crasanakis

*Attorney, Agent, or Firm*—Stanley M. Welsh

[57] ABSTRACT

A reforming process is disclosed which comprises contacting a sulfur-containing hydrocarbon material in at least one scavenging or sulfur removal zone with at least one manganese-containing composition at conditions to remove at least a portion of said sulfur from said hydrocarbon material to produce a hydrocarbon feedstock having a reduced concentration of sulfur; and contacting said hydrocarbon feedstock with a catalyst comprising, optionally, a major amount of a porous solid support, a minor catalytically effective amount of at least one platinum-group metal component, optionally, a minor catalytically effective amount of at least one halogen component, and optionally, at least one rhenium component in the presence of hydrogen at hydrocarbon reforming conditions to obtain a hydrocarbon reformate product.

22 Claims, 4 Drawing Figures

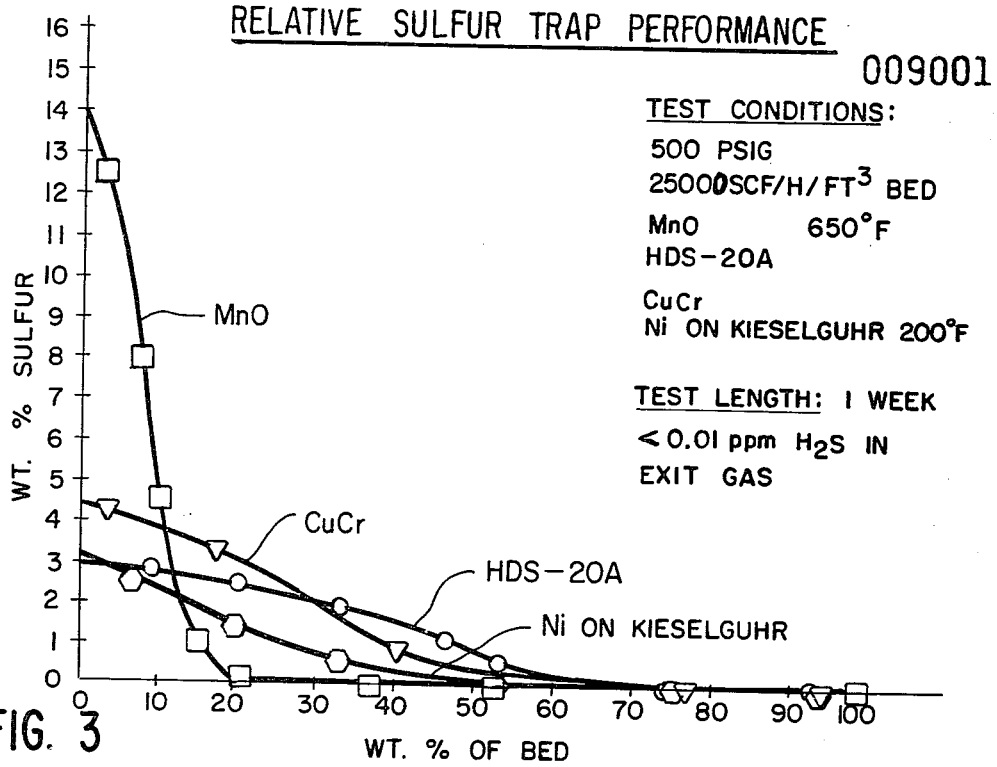
FIG. 3
FIG. 4
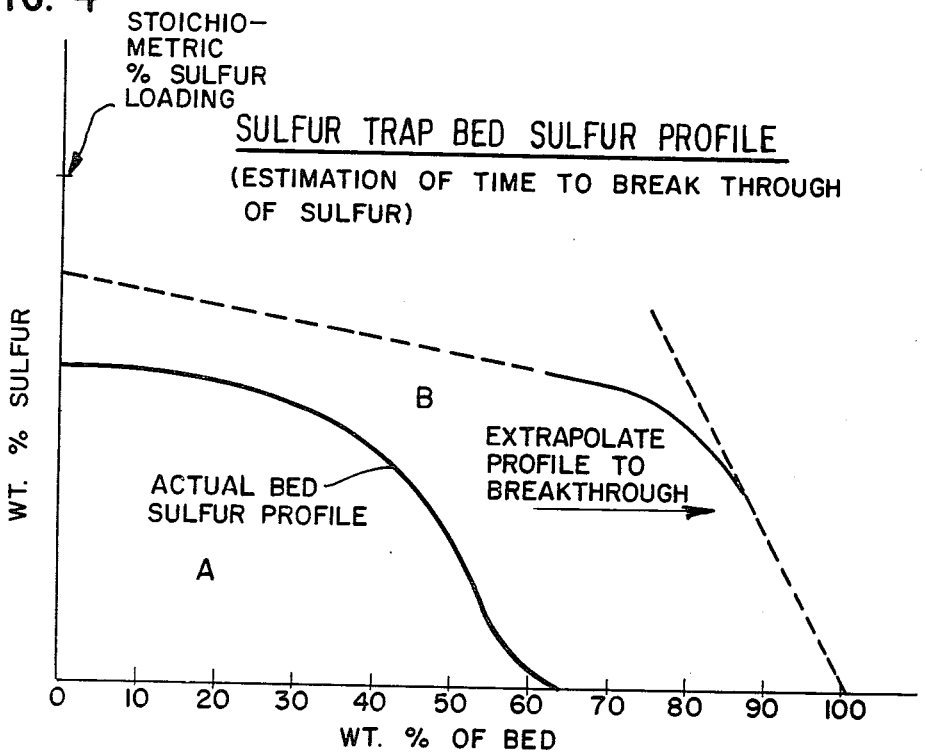

CATALYTIC REFORMING PROCESS WITH SULFUR REMOVAL

BACKGROUND OF THE INVENTION

1. Field of the Invention

This invention relates to removal of sulfur from a hydrocarbon material. More particularly, this invention relates to the use of a manganese-containing material in the removal of sulfur from hydrocarbon materials and subjecting the resulting reduced sulfur-containing hydrocarbon feedstock to hydrocarbon reforming.

Catalytic hydrocarbon reforming, a method to improve the octane value of a naphtha feedstock, is well known. Many of the catalysts used to carry out such a reforming process tend to be especially sulfur sensitive. Examples of such especially sulfur sensitive reforming catalysts are those employing a platinum-group metal, e.g., platinum, and optionally as a cometal component, rhenium. Several examples of reforming processes are fixed-bed hydroforming (Standard Oil Development Company, M. W. Kellogg Company, and Standard Oil Company (Indiana)), Platforming (Universal Oil Products Company), Catforming (Atlantic Refining Company), Houdriforming (Houdry Process Corporation), Ultraforming (Standard Oil Company (Indiana)), Rexforming (Universal Oil Products Company), Powerforming (Esso Research and Engineering Company), Magnaforming (Engelhard Minerals and Chemicals Corporation), and Rheniforming (Chevron Research Company).

Under the high hydrogen partial pressure condition used in catalytic reforming, sulfur compounds are readily converted into hydrogen sulfide which, unless removed, will build up to a high concentration in hydrogen recycle gas. It becomes especially important in view of the high sulfur sensitivity of platinum-group metal reforming catalysts to use feedstocks having reduced sulfur levels, e.g. of less than about 1 ppm. "Reforming" is meant herein and in the claims to be a catalytic process wherein a hydrocarbon feedstock is contacted with a hydrocarbon reforming catalyst in the presence of hydrogen at hydrocarbon reforming conditions to produce at least one reformate product having an increased octane value, e.g., Research Octane Number (RON) relative to that of the hydrocarbon feedstock.

K. E. Louder et al. U.S. Pat. No. 3,898,153 (1975) disclose an improvement in catalytic reforming of naphthas wherein a hydro-treated feedstock is passed through a zinc oxide bed preceded by a chloride scavenging zone. The chloride scavenging zone is necessary because hydrochloric acid gas in the reformer recycle gas reacts with zinc oxide to form zinc chloride. The zinc chloride in turn is carried into the reforming zone where it adversely affects the reforming catalyst.

P. R. Westermoreland et al. in *Environmental Science and Technology,* Volume 11, Pages 488–491, report initial rates for reaction between $H_2S$ in a mixture of $H_2S$ and $H_2$ and MnO, CaO, ZnO and $V_2O_3$ over a temperature range of 570°–1470° F. (300°–800° C.). Manganous oxide was reported to have the highest reaction rate and possessed favorable properties for a high temperature desulfurization process.

Removal of sulfur, either from waste gas or industrial exhaust or flue gases, by means of an oxide of manganese is disclosed in the following patents: U.S. Pat. No. 3,761,570 (1973), U.S. Pat. No. 3,723,598 (1973), U.S. Pat. No. 3,492,083 (1970) and British Pat. No. 1,144,071.

Removal of sulfur from carbonaceous solid fuels by conversion of sulfur impurities to hydrogen sulfide followed by absorption of the hydrogen sulfide on supported manganese oxide is disclosed in the following U.S. Pat. Nos: 2,927,063 (1960), 2,950,229 (1960), 2,950,231 (1960), and 3,101,303 (1963).

Methods for regenerating manganous oxide are disclosed in the following U.S. Pat. Nos. 2,927,063 (1960), 2,950,229 (1960), 3,492,083 (1970) and 3,101,303 (1963).

U.S. Pat. No. 4,045,331 (1977) discloses a process for both demetalization and desulfurization of a petroleum feedstock by means of a manganese oxide supported on an alumina.

U.S. Pat. No. 3,063,936 (1962) discloses removal of $H_2S$ produced during a catalytic hydrodesulfurization of a naphtha fraction by contacting the hydrotreated feedstock in the vapor phase at about 662° F. (350° C.) with an absorbing material comprising zinc oxide (reported to be preferred), manganese oxide or iron oxide. The desulfurized naphtha is then used in a steam-reforming process for the production of methanol synthesis gases.

Many of the references suggest that zinc oxide and manganese oxide are equally effective and can be used interchangeably. This teaching is misleading when halides are present. For example, none of the references teach or suggest that where halogen-containing compounds are present and can both contact and react with the material for removing sulfur, a means for scavenging halide, required in the case of zinc oxide, is not required in the case of manganese oxide. Halogen-containing compounds are often present in the hydrocarbon feedstock, the hydrogen recycle line, and/or the reforming zone due to addition of halogen-containing compounds into any and all of these in order to maintain the halogen content on a, e.g. platinum-group metal containing, reforming catalyst.

As a reactant, manganous oxide has a significantly greater propensity than zinc oxide to absorb or react with hydrochloric acid under the following process conditions: temperature in the range 600° to 1000° F. (316° to 538° C.) preferably 650° to 850° F. (343° to 454° C.), pressure in the range 150–750 psig., a hydrogen concentration in the range 1/1 to 30/1 moles of hydrogen per mole of hydrocarbon, and a space velocity (vhsv) in the range 500–50,000 vol. of gas/hour/vol. of reactant.

It has been found that a manganese component, preferably a manganese oxide, will scavenge hydrogen sulfide significantly more effectively than zinc oxide as shown in Example 3. Further, it has been discovered surprisingly that unlike zinc oxide, manganese in the form of an oxide, halide or sulfide has a negligible, if any, adverse affect on a platinum-group metal reforming catalyst after an activationregeneration cycle as shown in Example 5.

BRIEF DESCRIPTION OF THE INVENTION

It is an object of this invention to provide a method for the effective removal of sulfur from sulfur-containing hydrogen and/or hydrocarbon materials, to produce hydrogen and/or hydrocarbon feedstocks having reduced sulfur content for a reforming process which utilizes a sulfur sensitive catalyst. It is an object of this invention to provide a hydrocarbon reforming process involving sulfur removal from hydrogen and/or hydrocarbon materials which achieves improved results relative to prior art processes involving sulfur removal with zinc oxide.

The hydrocarbon materials used in the present process comprise hydrocarbon fractions containing naphthenes and paraffins that, preferably boil primarily within the gasoline range. Typically, the hydrocarbon materials used comprise about 20% to about 70% by weight of naphthenes and about 25% to about 75% by weight of paraffins. The preferred hydrocarbons material for use as feed and chargestock consists essentially of naphthenes and paraffins, although in some cases aromatics and/or olefins may also be present. When aromatics are included, these compounds comprise about 5% to about 25% by weight of the total hydrocarbon material. A preferred class of hydrocarbon feed or chargestock includes straight run gasolines, natural gasolines, synthetic gasolines and the like. On the other hand, it is frequently advantageous to use as hydrocarbon feed and chargestock thermally or catalytically cracked gasolines or higher boiling fractions thereof, called heavy naphthas. Mixtures of straight run and cracked gasolines can also be used. The gasoline used as hydrocarbon feed and chargestock may be full boiling range gasoline having an initial boiling point within the range of about 50° F. to about 150° F. (10° C. to 66° C.) and an end boiling point within the range of about 325° F. to about 425° F. (163° C. to 218° C.) or may be selected fraction thereof which generally will be a higher boiling fraction commonly referred to as a heavy naphtha—for example, a naphtha boiling in the range of a $C_7$ to about 400° F. (204° C.) In some cases, it is also advantageous to use pure hydrocarbons or mixtures of hydrocarbons that have been extracted from hydrocarbon distillates—for example, straight-chain paraffins—which are to be converted to aromatics.

DETAILED DESCRIPTION OF THE INVENTION

Broadly this invention comprises a process for removal of a sulfur component from sulfur-containing hydrogen and/or hydrocarbon material by contacting a manganese-containing material or composition with the hydrogen and/or hydrocarbon material. The manganese component of such a manganese-containing material is present in an effective amount sufficient to provide desired removal of sulfur-containing compounds, such as for example, $H_2S$ present in the hydrogen and/or hydrocarbon material. The period of contacting is sufficient to permit the desired removal of sulfur-containing compounds from the hydrogen and/or hydrocarbon material. Preferably, the manganese component is combined with a suitable binder or support to make pellets which preferably have sufficient crush strength for the application intended. Examples of suitable binders or supports are clays, graphite, alumina, zirconia, chromia, magnesia, curia, boria, silica-alumina, silica-magnesia, chromia-alumina, alumina-boria, alumina-silicaboron phosphate, silica-zirconia, and alumina and silica combinations.

In one embodiment of this invention, an initial concentration of sulfur component, calculated as elemental sulfur, in the hydrogen and/or hydrocarbon material to be contacted with the manganese component during normal operation as opposed to an upset condition is preferably in the range of about 0.1 to about 100 parts per million (ppm.) by weight, and more preferably about 0.2 to about 50 ppm. by weight. An upset condition occurs when the amount of sulfur-containing components of the hydrogen and/or hydrocarbon material increase to well over 100 ppm. by weight, e.g., in excess of 500 ppm. by weight. This condition can occur for example, due to a malfunction of the sulfur stripping zone of a hydrodesulfurization system. The sulfur component concentration of the hydrogen and/or hydrocarbon material subsequent to being contacted with the manganese-containing material of the present invention is preferably in the range of less than about 2 ppm. by weight and more preferably less than about 0.2 ppm. by weight and still more preferably less than about 0.1 ppm. by weight.

There are several methods by which a manganese component can be composited with a binder or support. One such method, for example, contemplates impregnating a support in the form of either a pellet or extrudate with an aqueous solution of a manganese salt, such as manganous chloride, manganous nitrate, etc. Comulling methods are equally appropriate; for example, manganese oxide binders can be mulled with a solid binder, such as cited earlier, preferably alumina, with sufficient water and cosolvent, e.g. acetic or nitric acid solutions, to create a paste extrudable through a die.

Alternatively, the binder can be co-mulled with an aqueous solution of a manganese salt until an extrudable paste is formed. By these and other conventional methods, manganese may be composited with the binder or support.

Calcination at a temperature between about 450° and 1600° F. (232° and 870° C.) preferably between 550° and 1000° F. (288° and 538° C.), and more preferably between about 600° and 900° F. (316° and 482° C.) is carried out subsequent to impregnation or comulling of a manganese salt into or with a binder or support, e.g. of alumina. This calcination procedure produces a reactant or manganese-containing material containing one or more of the common oxides of manganese. Examples of such common oxides are MnO, $MnO_2$, $MnO_3$, $Mn_2O_3$, $Mn_2O_7$, $Mn_3O_4$, and $Mn_2O_4$.

Manganese-containing material when at least a portion thereof is in the form of particles has at least a portion, preferably a majority by weight, of such particles each with an overall average diameter in the range of about ½" to about 1/32", and more preferably in the range of about ¼" to about 1/16".

The percent by weight as based upon the total weight of the manganese-containing material or composition of the manganese (calculated as MnO) is preferably in the range of about 35% to 99% by weight, and more preferably about 50% to 95% by weight.

A preferred method for reducing the sulfur content (calculated as elemental sulfur) of a hydrocarbon material into a range of about 0.1 to about 10 ppm. is a process of hydrocarbon hydrotreating or hydrofining. Hydrocarbon hydrotreating or hydrofining, as defined herein means a process wherein a hydrocarbon material containing an undesirable contaminant, e.g. sulfur or nitrogen, is contacted with a catalyst in the presence of hydrogen ($H_2$) at conditions to form compounds, e.g. $H_2S$ and $NH_3$, of the undesirable contaminants which can be removed from the hydrocarbon material by conventional means, e.g. simple distillation.

Examples of catalysts employed in hydrofining are comprised of composites of Group VIB or Group VIII metal hydrogenating (hydrogen transfer) components, or both, with an inorganic oxide base, or support, typically alumina. Typical catalysts are molybdena on alumina, cobalt molybdate on alumina, nickel molybdate on alumina or nickel tungstate. The specific catalyst used depends on the particular application. Cobalt molybdate catalyst is often used when sulfur removal is the primary interest. The nickel catalysts find application in the treating of cracked feedstocks for olefin or aromatic saturation. Sweetening (removal of mercaptans) is a preferred application for molybdena catalysts.

Three basic types of hydrocarbon reactions occur in processing feeds during hydrofining; a first which involves removal of sulfur by hydrodesulfurization (sulfur being eliminated in the form of hydrogen sulfide), a second which involves the removal of oxygen to improve stability and combustion characteristics, and a third involving the saturation of olefins and aromatic compounds with hydrogen. As to the first type, essentially four types of sulfur containing compounds, i.e., mercaptans, disulfides, thiophenes and benzothiophenes, are involved in the hydrodesulfurization reactions. The mercaptans and disulfide types are representive of a high percentage of the total sulfur found in the lighter virgin oils, such as virgin naphtha and heating oil. The thiophenes and benzothiophenes generally appear as the predominant sulfur form in heavy virgin oils and in cracked stocks of all boiling ranges. In the type of reaction involving oxygen removal, hydrogen reacts with oxygen compounds; condensation of the hydroxyl groups with hydrogen forms water. The removal of oxygen provides stable and clean burning fuels, and the hydrofinates are generally free of oxygen compounds.

Suitable desulfurization conditions useful in this invention include a quantity of catalyst, preferably disposed in one or more fixed-bed reaction zones, such that the liquid hourly space velocity (defined as volumes of fresh feed charge per hour per volume of catalyst disposed within the zone) is preferably within the range from about 0.4 to about 10.0. In general, lower space velocities are utilized with higher boiling, more severely contaminated feedstocks, while higher space velocities are utilized with feedstocks which are not severely contaminated. Hydrogen circulation through the catalyst bed, during processing, is a preferred technique from the standpoint of maintaining a "clean" catalytic composite, or one in which the deactivation rate due to the deposition of carbonaceous material is inhibited. Hydrogen circulation rates ranging from about 450 to about 15,000 standard cubic feet per barrel (scf/b), preferably about 500 to about 3000 scf/b are utilized, depending primarily on the character of the feedstock material and the desired results. Operating pressures will generally range from about 150 to about 5,000 psig, preferably about 200 to 750 psig while the catalyst bed inlet temperature is generally maintained in the range from about 200° to about 800° F. (93° to 425° C.), preferably about 400° to 700° F. (205° to 370° C.). Since the reactions being effected are exothermic in nature, a temperature increase will be experienced as the feedstock flows through the catalyst bed resulting in a higher catalyst bed outlet temperature. A preferred technique limits the temperature increase to about 100° F. (38° C.), and sometimes even about 250° F. (121° C.). Conventional quench streams introduced at intermediate locations in the catalyst bed can be used to control bed temperatures.

In order to significantly reduce the sulfur content of a hydrocarbon material in the presence of $H_2$, the preferred process conditions within a zone containing a manganese-containing material as reactant are: temperature in the range of about 600° to 1000° F. (315° to 538° C.), more preferably about 650° to 850° F. (343° to 454°.0 C.), a pressure in the range of about 150 to 750 psig and preferably 150 to 700 psig, a hydrogen/hydrocarbon mole ratio in the range of about 1/1 to 30/1 and a space velocity in the range of about 500 to 50,000 volume of gas/hour/volume of reactant.

In order to significantly reduce the sulfur content of a hydrocarbon material in the substantial absence of $H_2$, e.g. when the amount of $H_2$ present in the hydrocarbon material is less than about 2% by weight of that hydrocarbon material, the preferred process conditions within a zone containing a manganese-containing material as reactant are: temperatures in the range of about 500° to 1000° F. (260° to 538° C.), more preferably, about 650° to 850° F. (343° to 454° C.), a pressure in the range of about 50 to 750 psig. and preferably 150 to 700 psig., and a space velocity in the range of about 500 to 50,000 volume of gas/hour/volume of reactant.

The reforming catalyst useful in the present invention comprises a solid porous support, e.g., alumina, at least one platinum-group metal component and preferably at least one halogen component. It is preferred that the solid porous support be a material comprising a major amount of alumina having a surface area of about 25 $m.^2/gm.$ to about 600 $m.^2/gm.$ or more. The solid porous support comprises a major proportion, preferably at least about 80%, and more preferably at least about 90%, by weight of the catalyst. The preferred catalyst support, or base, is an alumina derived from hydrous alumina predominating in alumina trihydrate, alumina monohydrate, amorphous hydrous alumina and mixtures thereof; more preferably, alumina monohydrate, amorphous hydrous alumina and mixtures thereof, which alumina when formed as pellets and calcined, has an apparent bulk density of about 0.60 gm./cc. to about 0.85 gm./cc., pore volume of about 0.45 cc./gm. to about 0.70 cc./gm., and surface area of about 100 $m.^2/gm.$ to about 500 $m.^2/gm.$ The solid porous support may contain, in addition, minor proportions of other well known refractory inorganic oxides such as silica, zirconia, magnesia and the like. However, the most preferred support is substantially pure alumina derived from hydrous alumina predominating in alumina monohydrate, amorphous hydrous alumina and mixtures thereof.

The alumina support may be synthetically prepared in any suitable manner and may be activated prior to use by one or more treatments including drying, calcination, steaming and the like. Thus, for instance, hydrated alumina in the form of a hydrogel can be precipitated from an aqueous solution of a soluble aluminum salt such as aluminum chloride. Ammonium hydroxide is a useful agent for effecting the precipitation. Control of the pH to maintain it within the values of about 7 to about 10 during the precipitation is desirable for obtaining a good rate of conversion. Extraneous ions, such as halide ions, which are introduced in preparing the hydrogel, can, if desired, be removed by filtering the alumina hydrogel from its mother liquor and washing the filter cake with water. Also, if desired, the hydrogel can be aged, say for a period of several days. The effect of such aging is to build up the concentration of alumina trihydrate in the hydrogel. Such trihydrate formation can also be enhanced by seeding an aqueous slurry of the hydrogel with alumina trihydrate crystallites, for example, gibbsite.

The alumina may be formed into macrosize particles of any desired shape such as pills, cakes, extrudates, powders, granules, spheres, and the like using conventional methods. The size selected for the macrosize particles can be dependent upon the intended environment in which the final catalyst is to be used—as, for example, whether in a fixed or moving bed reaction system. Thus, for example, where as in the preferred embodiment of the present invention, the final catalyst is designed for use in hydrocarbon reforming operations employing a fixed bed of catalyst, the alumina will preferably be formed into particles having a minimum dimension of at least about 0.01 inch and a maximum dimension up to about one-half inch or one inch or more. Spherical particles having a diameter of about 0.03 inch to about 0.25 inch, preferably about 0.03 inch to about 0.15 inch, are often useful, especially in a moving bed reforming operation.

As indicated above, the catalyst utilized in the present invention also contains a platinum-group metal. The platinum-group metals include platinum, palladium, rhodium, iridium, ruthenium, osmium and the like with platinum being preferred for use in the present invention. The platinum-group metal, such as platinum, may exist within the final catalyst at least in part as a compound such as an oxide, sulfide, halide and the like, or in the elemental state. The platinum-group metal component preferably comprises about 0.01% to about 3.0%, more preferably about 0.05% to about 1.0%, by weight of the catalyst, calculated in an elemental state. Excellent results are obtained when the catalyst contains about 0.2% to about 0.9% by weight of the platinum-group metal component.

The platinum group component may be incorporated in the catalyst in any suitable manner, such as by co-precipitation or cogellation with the alumina support, ion-exchange with the alumina support and/or alumina hydrogel, or by the impregnation of the alumina support and/or alumina hydrogel at any stage in its preparation and either after or before calcination of the alumina hydrogel. One preferred method for adding the platinum-group metal to the alumina support involves the utilization of a water soluble compound of the platinum-group metal to impregnate the alumina support prior to calcination. For example, platinum may be added to the support by comingling the uncalcined alumina with an aqueous solution of chloroplatinic acid. Other water-soluble compounds of platinum may be employed as impregnation solutions, including, for example, ammonium chloroplatinate and platinum chloride. The utilization of a platinum-chlorine compound, such as chloroplatinic acid, is preferred since it facilitates the incorporation of both the platinum and at least a minor quantity of the halogen component of the catalyst, described hereinafter. It is preferred to impregnate the support with the platinum-group metal when it, the support, is in a hydrous state. Following this impregnation, the resulting impregnated support is shaped (e.g., extruded), dried and subjected to a high temperature calcination or oxidation procedure at a temperature in the range of about 700° F. to about 1500° F. (370° to 815° C.), preferably of about 850° F. to about 1300° F. (454° to 704° C.), for a period of time of about one hour to about 20 hours, preferably of about one hour to about five hours. The major portion of the halogen component can be added to this otherwise fully composited calcined catalyst by contacting this catalyst with a substantially anhydrous stream of halogen-containing gas.

An optional and preferred constituent of the catalyst utilized in the present invention is an additional component exemplified by rhenium. This component may be present as an elemental metal, as a chemical compound, such as the oxide, sulfide, or halide, or in a physical or chemical association with the alumina support and/or the other components of the catalyst. Generally, the rhenium is utilized in an amount which results in a catalyst containing about 0.01% to about 5%, preferably about 0.05% to about 1.0%, by weight of rhenium, calculated as the elemental metal. The rhenium component may be incorporated in the catalyst in any suitable manner and at any stage in the preparation of the catalyst. The procedure for incorporating the rhenium component may involve the impregnation of the alumina support or its precursor either before, during or after the time the other components referred to above are added. The impregnation solution can in some cases be an aqueous solution of a suitable rhenium salt such as ammonium perrhenate, and the like salts or it may be an aqueous solution of perrhenic acid. In addition, gaseous solutions of rhenium halides such as the chloride may be used if desired. It is preferred to use perrhenic acid as the source of rhenium for the catalysts utilized in the present invention. In general, the rhenium component can be impregnated either prior to, simultaneously with, or after the platinum-group metal component is added to the support. However, it has been found that good results are achieved when the rhenium component is impregnated simultaneously with the platinum-group component. In the instance where the catalyst support, e.g. alumina derived from hydrous alumina predominating in alumina monohydrate is formed into spheres using the conventional oil drop method, it is preferred to add the platinum-group metal and rhenium after calcination of the spheroidal particles. The presently useful catalyst may include a minor, catalytically effective amount of one or more other well known promoters, such as germanium, tin, gold, cadmium, lead, the rare earth metals, and mixtures thereof.

Another optional and preferred constituent of the catalyst used in the present invention is a halogen component. Although the precise chemistry of the association of the halogen component with the alumina support is not entirely known, it is customary in the art to refer to the halogen component as being combined with the alumina support, or with the other ingredients of the catalyst. This combined halogen may be fluorine, chlorine, bromine, and mixtures thereof. Of these, fluorine and, particularly, chlorine are preferred for the purposes of the present invention. The halogen may be added to the alumina support in any suitable manner, either during preparation of the support, or before or after the addition of the catalytically active metallic component or components. For example, at least a portion of the halogen may be added at any stage of the preparation of the support, or to the calcined catalyst support, as an aqueous solution of an acid such as hydrogen fluoride, hydrogen chloride, hydrogen bromide and the like or as a substantially anhydrous gaseous stream of these halogen-containing components. The halogen component, or a portion thereof, may be composited with alumina during the impregnation of the latter with the platinum-group component and/or rhenium component; for example, through the utilization of a mixture of chloroplatinic acid and/or perrhenic acid and hydrogen chloride. In another situation, the alumina hydrogel which is typically utilized to form the alumina component may contain halogen and thus, contribute at least a portion of the halogen component to the final composition or composite. For purposes of the present invention, when the catalyst support is used in the form of an extrudate, the major portion of the halogen component can be added to the otherwise fully composited calcined catalyst by contacting this catalyst with a stream of halogen-containing gas. When the catalyst is prepared by impregnating calcined, formed alumina, for example, spheres produced by the conventional oil drop method, it is preferred to impregnate the support simultaneously with the platinum-group metal, rhenium component and halogen. In any event, the halogen is preferably added in such a manner as to result in a fully composited catalyst that contains about 0.1% to about 5% and preferably about 0.2% to about 1.5% by weight of halogen calculated on an elemental basis.

The final fully composited catalyst prepared, for example, by a method set forth above, is generally dried at a temperature of about 200° F. (93° C.) to about 600° F. (315° C.) for a period of about 2 to about 24 hours or more and finally calcined at a temperature of about 700° F. (370° C.) to about 1500° F., (815° C.) preferably about 850° F. (454° C.) to about 1300° F. (704° C.) for a period of about ¼ hour to about 20 hours and preferably about ¼ hour to about 5 hours.

The resultant calcined catalyst may be subjected to reduction prior to use in reforming hydrocarbons. This step is designed to insure chemical reduction of at least a portion of the metallic components.

The reducing media may be contacted with the calcined catalyst at a temperature of about 800° F. (427° C.) to about 1200° F. (649° C.) and at a pressure in the range of about 0 psig. to about 500 psig. and for period of time of about 0.5 to about 10 hours or more and, in any event, for a time which is effective to chemically reduce at least a portion, preferably a major portion, of each of the metallic components, e.g., platinum-group metal and rhenium component, of the catalyst. By chemical reduction is meant the lowering of oxidation states of the metallic components below the oxidation state of the metallic components in the unreduced catalyst. For example, the unreduced catalyst may contain platinum salts in which the platinum has an oxidation state which can be lowered or even reduced to elemental platinum by contacting the unreduced catalyst with hydrogen. This reduction treatment is preferably performed in situ, (i.e., in the reaction zone in which it is to be used), as part of a start-up operation using fresh unreduced catalyst or regenerated (e.g., regenerated by treatment with an oxygen-containing gas stream) catalyst. The process of the present invention may be practiced using virgin catalyst and/or catalyst that has previously been used to reform hydrocarbon and has been subsequently subjected to conventional treatments to restore, e.g., regenerate and/or reactivate, the hydrocarbon reforming activity and stability of the catalyst.

Hydrocarbon reforming conditions often include a hydrogen to hydrocarbon mole ratio in the range of about 1/1 to about 30/1, preferably about 2/1 to about 20/1; reaction pressure in the range of about 50 psig to about 1000 psig, preferably about 100 psig to about 600 psig and more preferably about 200 psig to about 400 psig; and a weight hourly space velocity, i.e., (whsv) in the range of about 0.5 to about 10.0 or more, preferably about 1.5 to about 6.0.

For optimum reforming results, the temperature in the reaction zone should preferably be within the range of about 700° F. (370° C.) to about 1100° F. (593° C.), more preferably in the range of about 800° F. (427° C.) to about 1050° F. (565° C.). The initial selection of the temperature within the broad range is made primarily as a function of the desired octane of the product reformate, considering the characteristics of the charge stock and of the catalyst. The temperature may be slowly increased during the run to compensate for the inevitable deactivation that occurs, to provide a constant octane product.

The content of halide on the reforming catalyst is preferably maintained throughout the reforming process in order to maintain the activity of the reforming catalyst. As the content of the halide on the catalyst decreases, the activity of the catalyst also tends to decrease. Optionally, halogen components are added to the reforming zone either with the feedstock and/or with the hydrogen ($H_2$) so as to maintain the halogen component content on the catalyst. Halide containing compounds which are added to the reforming zone preferably are or break down into hydrogen halide gas which readily reacts with the reforming catalyst so as to maintain the halide content at an optimal level for the catalyst. The addition of halide-containing compounds can result in the gas comprising hydrogen ($H_2$) and other volatile components in the recycle line containing a concentration of volatile halide compounds, e.g. hydrogen halide. The concentration in moles of volatile halide compounds to total moles of the gas is up to about 10 ppm., preferably up to about 5 ppm., and more preferably at least about 0.01 ppm. Preferably this concentration is in the range of between about 0.05 to about 1 ppm. Examples of compounds which may be added to the reforming zone either continuously with the reforming of hydrocarbon material or in the absence of hydrocarbon material are volatile hydrocarbon halides such as carbon tetrachloride, chloroform and the like.

BRIEF DESCRIPTION OF THE DRAWINGS

FIG. 3 is a graph showing the relative performance of sulfur traps employing MnO, CuCr, HDS-20A, and Ni on Kieselguhr.

FIG. 4 is a graph showing how breakthrough times are determined in Example 4.

DETAILED DESCRIPTION OF THE DRAWINGS

Figure 1:
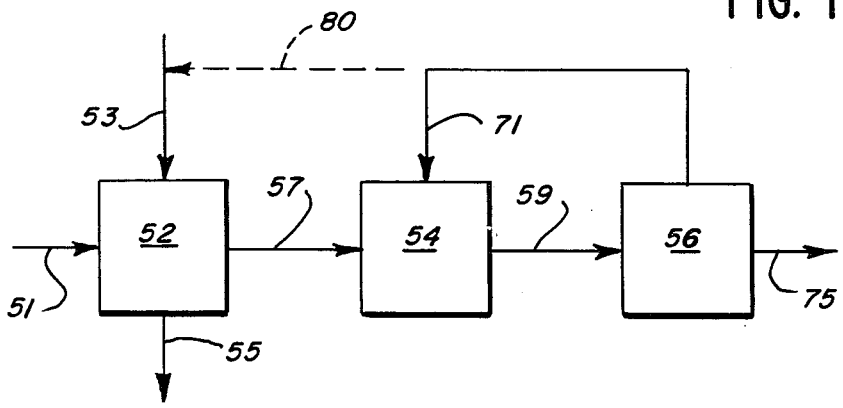
FIG. 1 is a schematic flow diagram of a reforming process employing both a hydrodesulfurization zone and a zone for trapping or absorbing hydrogen sulfide.

The flow diagram of FIG. 1 comprises transfer lines 51, 53, 55, 57, 59, 71, 75 and 80, a hydrodesulfurization zone 52, a zone 54 for removing or absorbing hydrogen sulfide gas and a reforming zone 56.

A naphtha feedstock enters hydrodesulfurization zone 52 via transfer line 51. Leaving hydrodesulfurization zone 52 via one or more transfer lines collectively represented by transfer line 55 are volatiles comprising, for example, low molecular weight hydrocarbons, hydrogen sulfide, ammonia and hydrogen. A hydrogen makeup line 53 transfers hydrogen into zone 52. A portion of this hydrogen may be taken from recycle line 71. The possibility of drawing some of this hydrogen from the recycle line is indicated by the dotted line 80. Hydrodesulfurized hydrocarbon feedstock is transferred from zone 52 to zone 54 where at least a portion of the residual hydrosulfide is removed by contact with a manganese-containing composition comprising, for example, an oxide or manganese. The hydrocarbon feedstock, having been treated by contact with an oxide of manganese, preferably manganous oxide, is then transferred via line 59 to reformer 56. Leaving reformer 56 via line 75 is the reformed product. Transferred through recycle line 71 from reformer 56 to sulfur trap zone 54 is a recycle gas comprising primarily hydrogen and volatile hydrocarbons, wherein the ratio in moles of hydrogen/hydrocarbon is in the range about 1/1 to 30/1, and preferably about 2/1 to 20/1.

Figure 2:
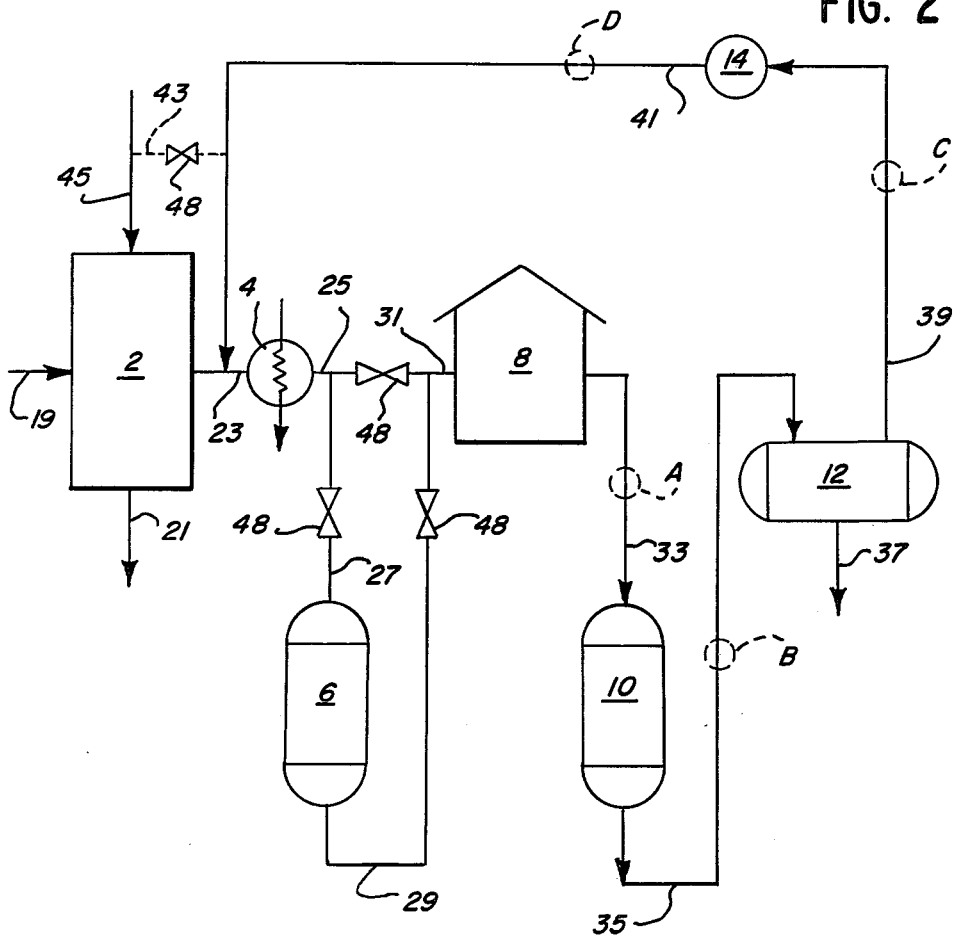
FIG. 2 is a system for reforming naphtha feedstocks.

FIG. 2 discloses a system for reforming hydrocarbon materials comprising a hydrodesulfurization zone 2, a heat exchanger 4, a zone 6 for absorbing or removing hydrogen sulfide (sulfur trap), a furnace 8, a reformer 10, a separator 12, a compressor 14, and transfer lines 19, 21, 23, 25, 27, 29, 31, 33, 35, 37, 39, 41, 43 and 45, and valves 48. Alternate locations for sulfur traps are indicated for locations A, B, C and D. A sulfur trap zone (not shown) can be located prior to the junction of transfer lines 41 and 23. The percent by weight of hydrogen ($H_2$) at this location is less than about 2% by weight based on hydrocarbon material also present at this location.

Hydrocarbon feedstock, e.g. straight-up, catalytically cracked, or thermally cracked naphthas, or any other naphtha fraction suitable for octane value improvement, boiling up to about 450° F. (232° C.) enters via line 19 into a hydrodesulfurization zone 2 where the feedstock is hydrotreated and organic sulfur is converted to hydrogen sulfide. Make-up hydrogen enters zone 2 via line 45. An optional take-off line from recycle line 41 can be tied indirectly into 45 as indicated by dotted line 43 to make use of a net excess of hydrogen produced in reformer 10.

Depending upon the severity of the hydrodesulfurization treatment, nitrogen compounds can also be hydrogenated to produce ammonia.

Leaving hydrodesulfurization zone 2 by means of one or more transfer lines collectively represented by transfer line 21 are volatiles comprising, for example, low molecular weight hydrocarbons, hydrogen sulfide, ammonia and hydrogen. Separation by means of transfer line 21 is achieved based on physical differences, e.g. vapor pressures or boiling points. Such separation based on physical properties is to be distinguished from separations based on chemical or physical interactions such as occurred in zone 6.

A variety of hydrodesulfurization catalysts can be used, which includes a combination of oxides of elements from Group 8 and Group 6*b* supported on a support, e.g. alumina.

Process conditions within the hydrodesulfurization reactor (not shown) but which is part of the hydrodesulfurization zone 2 schematically represented as a box involve temperatures in the range of about 200° F. (93° C.) to about 800° F. (427° C.), preferably in the range of about 400° F. (205° C.) to about 700° F. (370° C.), pressure in the range 150 psig to about 5000 psig preferably about 200 to about 750 psig hydrogen concentration in the range of about 450 scf/b to about 15,000 scf/b, preferably about 500 to 3000 scf/b, and a liquid hourly space velocity in the range of about 0.4 to about 10.

Hydrotreated material containing a significantly reduced concentration of sulfur, e.g. about 2 to about 20 ppm., is transferred in line 23 through a heat exchanger 4. The temperature of the hydrotreated material is raised to between about 550° F. (288° C.) and about 850° F. (455° C.) at a pressure of from about 150 to about 750 psig. Heated material passes via line 25 through valve 48 into line 27, then through zone 6 containing a supported manganese oxide and via line 29 through another valve 48 into transfer line 31. The arrangement of valves 48 permits a bypass of sulfur trap 6.

The heated material passing via line 31 is further heated in furnace 8 to a temperature in the range of about 850° F. (455° C.) to about 950° F. (510° C.).

The heated material from furnace 8 optionally can pass through a sulfur trap at location A and then into reformer 10.

In reformer 10, the heated hydrocarbon material is contacted with a typical reformer catalyst, e.g. a platinum-group metal catalyst preferably having a halide component and either with or without rhenium, at reforming conditions, such as a temperature in the range 650° F. (353° C.) to about 1050° F. (565° C.), a pressure in the range of about 5 psig to about 600 psig, a hydrogen/hydrocarbon mole ratio of about 1/1 to 30/1, and a space velocity in the range of about 0.5 to about 10. Ordinarily, two or more reforming zones with heaters therebetween in series are employed.

The reformed product produced in reformer 10 is transferred through line 35 to a separator 12. Separator 12 separates a liquid hydrocarbon product and a volatile product consisting of hydrogen and volatile hydrocarbons. The hydrogen and other volatiles, e.g. low molecular weight hydrocarbons, are removed through line 39 then into recycle line 41. Optionally, a portion of the volatiles can be passed through a sulfur trap at location C prior to entering line 41. A compressor 14 is located on line 41 to pressurize and transfer volatile components from line 39. The mole ratio of $H_2$/HC (hydrocarbon) in recycle line 41 is in the range of about 1/1 to about 30/1. Reformed liquid product exits through line 37.

In reformer 10, there is a reforming catalyst which contains a platinum-group metal component and a halogen component. The halogen component is replenished during the reforming cycle by adding volatile halides to the hydrocarbon material entering line 19. Optionally, volatile halides can be introduced into the $H_2$ make up line 45 or the recycle line 41. The concentration in moles of hydrohalide, e.g., HCl, per total moles of gas in recycle line 41 is in the range of about 0.05 to about 1 ppm. In any event, halides are preferably added either on a continuous or intermittent basis so as to maintain the halide content of the reforming catalyst.

A significant advantage of the process of this invention over that disclosed in U.S. Pat. No. 3,898,153 (1975) cited hereinbefore is the fact that there is no need to precede each sulfur trap of this invention with a trap or scavenging zone for volatile halides, e.g. chlorides.

EXAMPLE 1

The following thermodynamic calculations compare zinc oxide and manganous oxide and with EXAMPLES 3 and 4 establish that:

(1) Formation of metal sulfides from the oxides of both manganese and zinc is very favorable in the presence of hydrogen sulfide gas;

(2) The formation of zinc chloride from zinc oxide by reaction with hydrochloric acid gas is less thermodynamically favored than the formation of manganous chloride from manganous oxide. However, as a reactant, both manganous chloride and zinc chloride are not thermodynamically favored under the following conditions: temperature in the range 650° to 1000° F. (343° to 538° C.), an $H_2O/Cl$ mole ratio in recycle gas of 20/1 to 60/1, a recycle mole ratio of $H_2/HC$ in the range 3/1 to 30/1, a pressure in the range 150–750 psig and a space velocity in the range 500 to 50,000 vol. of gas/hr./vol. of reactant.

(3) Conversion of the metal sulfide to the metal chloride in hydrogen sulfide gas by hydrochloric gas is less favorable with zinc sulfide than with manganous sulfide. The equilibrium data of Table 1 establishes this point.

In the CRC Handbook of Chemistry of Physics, Forty-Seventh Edition, 1966–1967, and the Bureau of Mines, Report of Investigations 5600, Thermodynamics Properties of Manganese and its Compounds by Alla D. Mah, there is reported that both zinc chloride and zinc metal have vapor pressures which are much higher than manganous chloride and are therefore expected to tend to migrate more quickly from a sulfur trap to a zone containing reforming catalyst upon the formation of any chlorides.

TABLE 1

$H_2S$ FROM MnS AND ZnS BY THE ACTION OF HCl AT HOUSTON 733 GUARD REACTOR CONDITIONS $MS(c) + 2HCl(g) = MCL_2(c,l) + H_2S(g)$
350 psig, 10 ppm $H_2O$, 30/1 $H_2O/Cl$ mole ratio

| M = | $H_2S$ at Equilibrium, ppm Molar Manganese | Zinc |
|---|---|---|
| Temp., ° F. | | |
| 440 | $1.7\times10^{-1}$ | $1.0\times10^{-2}$ |
| 620 | $2.2\times10^{-3}$ | $1.9\times10^{-5}$ |
| 800 | $9.7\times10^{-5}$ | $3.8\times10^{-7}$ |
| 980 | $9.3\times10^{-6}$ | $1.4\times10^{-8}$ |

Equilibria and Calculations $ZnO(c) + 2HCl(g) = ZnCl_2(c,l) + H_2O(g)$ $K = P_{H2O}/P^2_{HCl}$ The following equilibrium constants were calculated from an expression which relates $K_e$ to temperature.

| °F. | °K. | |
|---|---|---|
| 440 | 500 | $6.76\times10^5$ |
| 620 | 600 | $3.31\times10^3$ |
| 800 | 700 | $7.41\times10^1$ |
| 980 | 800 | $4.29\times10^0$ |

Source: Kitchner, J. A. Ignatowicz, S., Trans. Faraday Soc. 47,1278, (1951).

$$\log_{10}K' = \log_{10}(P^2_{HCl}/P_{H2O}) = \frac{-6{,}930}{T} + 8.03$$

p = atm
T = °K.
K' = reverse of reaction A
$\log_{10}K' = -\log_{10} K$

The $K_e$ values listed above were used to calculate the $HCl_{actual}/HCl_{equil}$ numbers for zinc shown below

| Temp., °F. | $H_2O/Cl$ | $HCl_{actual}/HCl_{equil}$ at 10 ppm $H_2O$ | at 20 ppm $H_2O$ |
|---|---|---|---|
| 600 | 5 | 2.34 E-1 | 3.02 E0 |
| | 15 | 7.83 E-2 | 1.10 E-1 |
| | 30 | 3.91 E-2 | 5.53 E-2 |
| | 100 | 1.17 E-2 | 1.66 E-2 |
| 700 | 5 | 7.22 E-2 | 1.02 E-1 |
| | 15 | 2.41 E-2 | 3.40 E-2 |
| | 30 | 1.20 E-2 | 1.71 E-2 |
| | 100 | 3.60 E-3 | 5.11 E-3 |
| 800 | 5 | 2.72 E-2 | 3.83 E-2 |
| | 15 | 9.07 E-3 | 1.28 E-2 |
| | 30 | 4.52 E-3 | 6.41 E-3 |
| | 100 | 1.36 E-3 | 1.92 E-3 |

Total pressure was 350 psig.

Equilibria and Calculations $MnO(c) + 2HCl(g) = MnCl_2(c,l) + H_2O(g)$ $K = P_{H2O}P^2_{HCl}$ Equilibrium Constants*

TABLE 1-continued $H_2S$ FROM MnS AND ZnS BY THE ACTION OF HCl AT HOUSTON 733 GUARD REACTOR CONDITIONS

| °K. | $K_{Equil}$ |
|---|---|
| 500 | $2.90\times10^9$ |
| 600 | $6.21\times10^6$ |
| 700 | $7.98\times10^4$ |
| 800 | $3.14\times10^3$ |

Equilibrium Constants, °F., Interpolated**

| °F. | $K_{Equil}$ |
|---|---|
| 600 | $1.25\times10^7$ |
| 650 | $3.04\times10^6$ |
| 700 | $8.40\times10^5$ |
| 750 | $2.58\times10^5$ |
| 800 | $8.68\times10^4$ |
| 850 | $3.18\times10^4$ |
| 900 | $1.26\times10^4$ |

*See page 21 Bureau of Mines, Report of Investigations 5600, entitled Thermodynamic Properties of Manganese and Its Compounds, by Alla D. Mah

**Interpolated using a linear fit of log K vs. 1/°R.

| Temp., °F. | $H_2O/Cl$ | $HCl_{actual}/HCl_{equil}$ at 10 ppm $H_2O$ | at 20 ppm $H_2O$ |
|---|---|---|---|
| 600 | 5 | 1.11 E1 | 1.57 E1 |
| | 15 | 3.71 E0 | 5.24 E0 |
| | 30 | 1.85 E0 | 2.63 E0 |
| | 100 | 5.54 E-1 | 7.86 E-1 |
| 650 | 5 | 5.50 E0 | 7.76 E0 |
| | 15 | 1.84 E0 | 2.59 E0 |
| | 30 | 9.17 E-1 | 1.30 E0 |
| | 100 | 2.75 E-1 | 3.88 E-1 |
| 700 | 5 | 2.89 E0 | 4.09 E0 |
| | 15 | 9.65 E-1 | 1.36 E0 |
| | 30 | 4.81 E-1 | 6.83 E-1 |
| | 100 | 1.44 E-1 | 2.05 E-1 |
| 750 | 5 | 1.60 E0 | 2.26 E0 |
| | 15 | 5.35 E-1 | 7.54 E-1 |
| | 30 | 2.67 E-1 | 3.78 E-1 |
| | 100 | 8.00 E-2 | 1.13 E-1 |
| 800 | 5 | 9.29 E-1 | 1.31 E0 |
| | 15 | 3.10 E-1 | 4.38 E-1 |
| | 30 | 1.55 E-1 | 2.20 E-1 |
| | 100 | 4.64 E-2 | 6.57 E-2 |
| 850 | 5 | 5.63 E-1 | 7.94 E-1 |
| | 15 | 1.88 E-1 | 2.65 E-1 |
| | 30 | 9.38 E-2 | 1.33 E-1 |
| | 100 | 2.81 E-2 | 3.98 E-2 |

Total pressure was 350 psig.

B. $ZnS (c) + 2HCl(g) = ZnCl_2(c,l) + H_2S(g)$

Equilibrium Constants*

| °K. | $K_{eq}$ |
|---|---|
| 500 | $3.69\times10^3$ |
| 600 | $6.94\times10^0$ |
| 700 | $1.36\times10^{-1}$ |
| 800 | $5.07\times10^{-3}$ |

*Calculated from ΔG° values as tabulated below.

Free Energy of Formation, ΔG°, Kcal/mole

| °K. | 500 | 600 | 700 | 800 | Ref. |
|---|---|---|---|---|---|
| ZnS | −39.58 | −39.17 | 2HCl 38.73 | −38.26 | A |
| HCl | −23.22 | −23.42 | −23.60 | −23.77 | B |
| $ZnCl_2$** | −78.71 | −73.93 | −69.88 | −65.27 | |
| $H_2S$ | −15.47 | −14.39 | −13.27 | −12.13 | C |
| $H_2O$ | −52.36 | −51.15 | −49.91 | −48.64 | D |

TABLE 1-continued

| $H_2S$ FROM MnS AND ZnS BY THE ACTION OF HCl AT HOUSTON 733 GUARD REACTOR CONDITIONS | | | | | |
|---|---|---|---|---|---|
| ZnO | −71.30 | −68.95 | −66.60 | −64.05 | E |

**Since these values could not be found directly in the literature at temperatures other than 298° K. (std. state), the numbers shown are back-calculated from $K_c$ values shown in Appendix Section A. for the $ZnO+2HCl = 3nCl_2+H_2O$ equilibrium and $\Delta G^\circ$ values for ZnO, HCl and $H_2O$ tabulated above. These numbers are believed to be accurate because the $\Delta G^\circ$ calculated at 298° K. (−87.8 Kcal/mole) by this method agrees well with the known value (−88.3 Kcal/mole).[F]

References:

A. U.S. Bureau of Mines Bulletin 601 (Reprint of 406), p. 65-66

B. U.S. Bureau of Mines Bulletin 668,p. 102

C. U.S. Bureau of Mines Bulletin 668, p. 103.

D. U.S. Bureau of Mines Bulletin 542, p. 22-23.

E. U.S. Bureau of Mines Bulletin 542, p. 58

F. NBS Technical Note 270-3, Selected Values of Chemical Thermodynamic Properties U.S. Dept. of Commerce.

EXAMPLE 2

A manganous oxide sulfur trap material was prepared as follows. Manganous oxide powder, as received from Diamond Shamrock, was tabletted with 5% graphite plus 3% Sterotex (a powdered vegetable stearine solid by Capital City Products Co., Columbus, Ohio) using a Stokes tabletting machine. The 3/8"×3/32" tablets were then calcined for three hours at 900° F. (482° C.) in a muffle furnace.

The crush strength of the above material was found to increase upon sulfiding.

EXAMPLE 3

The relative performance as a reactant for removing at least a portion of a sulfur component from a hydrogen ($H_2$) stream of the graphite supported manganous oxide (95% MnO/5% graphite) prepared according to Example 2, copper-chromia (CuCr) and nickel on kieselguhr are shown in FIG. 3. The processing conditions employed were 500 psig, 25000 SCF GAS/Hr/$Ft^3$ BED (60° F., 1 ATM), and nominally 2 ppm. $H_2S$ in plant $H_2$ as feedstock for about one week. In all tests, exit gas concentrations were less than 0.01 ppm. $H_2S$. The MnO was tested at 650° F. (343° C.). The copper chromia and nickel compositions were tested at 200° F. (93° C.) because they are suited only for recycle gas service.

HDS-20 is a cobalt-molybdenum trilobar catalyst, which is a material sold by American Cyanamid.

The 55% by weight of nickel on kieselguhr is a commercially available material sold by Harshaw Chemical Company, a Division of Kewanee Oil Co. of Cleveland, Ohio.

The copper-chromia material can be made according to methods disclosed in U.S. Pat. No. 4,049,842 (1977). The use here of this material is different from that disclosed in the patent.

The percent by weight of sulfur within the reactant was determined for each of ten equal segments along the length of a packed bed of a one-inch down flow standard reactor. A graph, beginning at the up-stream end, plotting the weight percent of sulfur in each of ten equal segments along the length of the down-stream reactor versus the corresponding segment is plotted in FIG. 3.

A significantly superior performance of manganous oxide is clear from the fact that the time at which significant amounts, e.g., greater than 1 ppm of hydrogen sulfide gas will leak through the sulfur trap material or reactant will occur last for the manganous oxide as compared to all others. This is shown by the approximation discussed in the following example.

EXAMPLE 4

An estimate of the time that hydrogen sulfide gas will break through a packed reactor in the case of zinc oxide versus manganous oxide is as follows: Referring to FIG. 4, a bed profile is experimentally determined wherein the percent by weight of sulfur loading is represented by an Area A. If breakthrough was not actually observed experimentally, the curve with Area B is approximated by moving the leading edge of the experimentally determined bed profile to the right until breakthrough would be expected to occur. A tangent is then taken at a point on the leading portion of this profile at expected breakthrough and extrapolated back to a reasonable loading of sulfur in percent by weight for segment 1 of the packed bed. In the case of manganous oxide, the maximum loading in percent by weight of segment 1 of the packed material was determined to be approximately midway between the percent by weight determined experimentally, and the maximum percent by weight theoretically obtainable at equilibrium. Of course, a variety of extrapolations are possible depending upon the point on the leading edge of the curve selected. Values greater than the percent by weight at equilibrium are clearly unreasonable and were rejected.

An estimate of the amount of sulfur within the total bed at the moment of breakthrough is the area under the curve for Area B approximated as above. The length of time it would take to pass that amount of sulfur through the bed under the processing conditions of the test yields an estimate of the breakthrough time.

Based on this method of approximation, a loading in weight percent of sulfur at breakthrough for manganous oxide was estimated to be 17% to 20%. A supplier of zinc oxide reported that the loading in weight percent of sulfur at breakthrough for zinc oxide was 3% under equivalent packing and operation conditions. The relative breakthrough time for these materials assuming equal packing weights, is directly proportional to the ratio of sulfur loadings for each at breakthrough. Therefore, the breakthrough time of manganous oxide is about 5.5 to 6.6 times that for zinc oxide.

EXAMPLE 5

In order to determine the consequence of adding either zinc oxide or manganous oxide to a reforming catalyst with regard to both activity and stability, the following test was run. An isothermal down flow one-inch reactor was filled with 20" of catalyst diluted with an inert material of tabular nonporous, neutral, alpha-alumina. A regulated flow of hydrogen and hydrocarbon (source of hydrocarbon Midcontinent Naphtha) was maintained at test conditions by a liquid level release and a pressure control. The test conditions employed were an isothermal temperature of 950° F. (510° C.) which is approximately 28°-50° F. (15°-28° C.) higher than normal, 300 psig, 3 moles of hydrogen per mole of hydrocarbon, a space velocity of 4 grams of hydrocarbon/hour/gram of catalyst and 20 grams of catalyst charged with a pseudolog dilution in five sections. The test length was 300 hours.

A linear fit was applied to averaged raw data so that the initial value for such averaged raw data is 100 Research Octane Number Clear (RONC) at time zero; then the average slope for the first one hundred hours is a measure of the average aging rate of the particular catalyst tested.

SUMMARY OF RESULTS

| | | Sulfur Trap Matl. | RONC | Del.RONC*/ 100 HRS. |
|---|---|---|---|---|
| A | (Virgin) | — | 99.6 ± .5 | −1.9 ± 0.2 |
| B | (Regen)** | MnO(10%) | 101.5 ± .5 | −5.1 ± 0.5 |
| A | (Virgin) | MnO(.05%) | 102.2 ± .5 | −1.9 ± 0.2 |
| A | (Virgin) | $MnCl_2$(.36%) | 101.5 ± .5 | −2.1 ± 0.2 |
| B | (Regen)** | ZnO(10%) | Less than 80 | Catalyst Dead, Test Aborted |

*Corrected to 100 RONC at zero time, and Del means delta for change in RONC
**Regen means a regenerated and a reactivated catalyst both which had previously been used to reform a Midcontinent Naphtha feedstock and to which about 10% by weight, as based on the catalyst, of powdered sulfur trap material had been added.

Two different reforming catalysts A (a platinum-rhenium catalyst) and B (a platinum catalyst) were employed. The impact on both activity and stability clearly indicates that in the case of zinc, the catalyst for all intents and purposes is ruined, whereas in the case of manganous oxide or manganous chloride, the catalyst is not adversely affected within experimental error.

The foregoing examples of this invention are intended to be illustrative only. Variations on the specific embodiments and examples disclosed would be obvious to a person of skill in the art based upon the teachings in this specification. Such variations are intended to be within the scope of this invention.

The embodiments of this invention in which an exclusive property or privilege is claimed are defined as follows:

1. A reforming process for a hydrocarbon material containing a sulfur component comprises: contacting in a fixed bed sulfur removal zone at sulfur removal conditions, said hydrocarbon material with a manganese-containing composition which comprises a manganese component cabable of removing at least a portion of said sulfur component at said sulfur removal conditions to produce a reduced sulfur-containing hydrocarbon feedstock, and contacting in a reforming zone in the presence of hydrogen at hydrocarbon reforming conditions said feedstock with a catalyst comprising a minor catalytically effective amount of a platinum-group metal component and a minor catalytically effective amount of a halogen component capable of reforming said feedstock at such reforming conditions to produce a reformed product.

2. The process of claim 1 wherein said manganese component comprises an oxide of manganese.

3. The process of claim 2 wherein said oxide of manganese comprises manganous oxide.

4. The process of claim 1 wherein said platinum-group metal component comprises platinum.

5. The process of claim 1 wherein the percent by weight of said manganese component, calculated as manganous oxide and based upon the total weight of said manganese-containing composition, is in the range of about 35 percent to about 99 percent by weight.

6. The process of claim 1 wherein said sulfur removal conditions comprise in the substantial absence of hydrogen a temperature in the range of about 500° to about 1000° F., a pressure in the range of about 150 to about 750 psig, and a space velocity in the range of about 500 to about 50,000 volume of gas/hour/volume of manganese-containing composition.

7. The process of claim 1 wherein said sulfur removal conditions comprise a temperature in the range of about 600° to about 1000° F., a pressure in the range of about 150 to about 750 psig, a hydrogen to hydrocarbon material mole ratio in the range of about 1/1 to about 30/1, and a space velocity in the range of about 500 to about 50,000 volume of gas/hour/volume of manganese-containing composition.

8. The process of claim 1 wherein the catalyst further comprises a minor catalytically effective amount of a rhenium component.

9. The process of claim 8, wherein the minor catalytically effective amount of the rhenium component, calculated as the elemental metal, is about 0.01 percent to about 5 percent by weight of the catalyst.

10. The process of claims 1, 4, or 9 wherein the platinum-group metal component, calculated on an elemental basis, is about 0.01 percent to about 3 percent by weight of the catalyst and the halide component, calculated on an elemental basis, is about 0.1 percent to about 5 percent by weight of the catalyst.

11. The process of claims 1, 5, 6, or 7 wherein at least a portion of the manganese-containing composition is in the form of particles each of which has an overall average diameter in the range of about ½" to about 1/32".

12. The process of claim 1 wherein the manganese-containing composition comprises a component selected from the group consisting of a clay, graphite, alumina, zirconia, chromia, magnesia, curia, boria, silica-alumina, silica-magnesia, chromia-alumina, alumina-boria, alumina-silica-boron phosphate, silica-zirconia, and alumina and silica combinations.

13. The process of claim 1 wherein the reforming conditions comprise a hydrogen to hydrocarbon mole ratio in the range of about 1/1 to about 30/1, a temperature within the range of about 700° to about 1100° F., a pressure in the range of about 50 to about 1000 psig, and a weight hourly space velocity in the range of about 0.5 to about 10.

14. The process of claim 1 wherein at least a portion of said hydrocarbon material is from a hydrodesulfurization zone wherein a hydrocarbon chargestock containing a sulfur component is contacted with a hydrodesulfurization catalyst at the following conditions: a catalyst bed inlet temperature in the range of from about 200° to about 800° F., a hydrogen circulation rate ranging from about 450 to about 15,000 standard cubic feet per barrel, a pressure in the range of about 150 to about 5000 psig, and a liquid hourly space velocity in the range of from about 0.4 to about 10.

15. The process of claims 12, 13, or 14 wherein at least a portion of the manganese-containing composition is in the form of particles each of which have an overall average diameter in the range of about ½" to about 1/32".

16. The process of claim 1 wherein a halide-containing material is introduced into the reforming zone.

17. The process of claim 16 wherein the halide-containing material is introduced into the reforming zone by adding the halide-containing material to the hydrocarbon material.

18. The process of claim 1 wherein there is a flow of at least a portion of hydrogen from the reforming zone to a sulfur removal zone through a recycle line and a halide-containing material is introduced into said recycle line.

19. The process of claim 18 wherein the concentration in moles of halide-containing material to total moles of gas in said recycle line is up to about 10 ppm.

20. The process of claim 19 wherein the concentration is up to about 1.0 ppm.

21. The process of claim 19 wherein the concentration is at least about 0.01 ppm.

22. The process of claim 1, wherein the initial concentration of sulfur component, calculated as elemental sulfur, in the hydrocarbon material during normal operation is in the range of about 0.1 to about 100 parts per million by weight.

* * * * *